US010415172B2

(12) United States Patent
Lv et al.

(10) Patent No.: US 10,415,172 B2
(45) Date of Patent: Sep. 17, 2019

(54) CONTROL METHOD FOR AUTOMATICALLY POSITIONING INNER TUB

(71) Applicant: QINGDAO HAIER WASHING MACHINE CO., LTD., Shandong (CN)

(72) Inventors: Peishi Lv, Shandong (CN); Lin Yang, Shandong (CN); Wenting Xu, Shandong (CN); Dafeng Fang, Shandong (CN); Yun Tian, Shandong (CN); Mingyan Shao, Shandong (CN)

(73) Assignee: QINGDAO HAIER WASHING MACHINE CO., LTD., Shandong, Qingdao (CN)

( * ) Notice: Subject to any disclaimer, the term of this patent is extended or adjusted under 35 U.S.C. 154(b) by 72 days.

(21) Appl. No.: 15/559,666

(22) PCT Filed: Nov. 23, 2015

(86) PCT No.: PCT/CN2015/095297

§ 371 (c)(1),
(2) Date: Sep. 19, 2017

(87) PCT Pub. No.: WO2016/150177

PCT Pub. Date: Sep. 29, 2016

(65) Prior Publication Data

US 2018/0371669 A1 Dec. 27, 2018

(30) Foreign Application Priority Data

Mar. 20, 2015 (CN) ..... 2015 1 0124293

(51) Int. Cl.
*D06F 37/30* (2006.01)
*D06F 39/08* (2006.01)
(Continued)

(52) U.S. Cl.
CPC ..... *D06F 37/302* (2013.01); *D06F 23/04* (2013.01); *D06F 37/26* (2013.01); *D06F 39/083* (2013.01); *D06F 37/12* (2013.01); *D06F 37/267* (2013.01)

(58) Field of Classification Search
CPC ..... D06F 37/302
See application file for complete search history.

(56) References Cited

U.S. PATENT DOCUMENTS 5,152,159 A 10/1992 Kabeya et al.

FOREIGN PATENT DOCUMENTS

CN 2749906 Y 1/2006
CN 101044277 A 9/2007
(Continued)

OTHER PUBLICATIONS

International Search Report (PCT/ISA/210) dated Mar. 2, 2016, by the Chinese Patent Office as the International Searching Authority for International Application No. PCT/CN2015/095297.
(Continued)

*Primary Examiner* — Jason Y Ko
(74) *Attorney, Agent, or Firm* — Buchanan Ingersoll & Rooney PC

(57) ABSTRACT

A control method for automatically positioning an inner tub. When the inner tub rotates to a certain position, a positioning pin at the bottom of an outer tub is released to press against the bottom of the inner tub, the inner tub continues to rotate, and when a positioning hole at the bottom of the inner tub is aligned with the positioning pin, the positioning pin stretches into the positioning hole, and thus the inner tub is locked. After the positioning pin is released, the inner tub continues to rotate under the effect of inertia, or the inner tub continues to rotate under the drive of a motor, when the inner tub rotates to the position where the positioning hole is
(Continued)

aligned with the positioning pin, the positioning pin stretches into the positioning hole to achieve automatic positioning and locking of the inner tub.

14 Claims, 3 Drawing Sheets

(51) Int. Cl.

| | |
|---|---|
| ***D06F 23/04*** | (2006.01) |
| ***D06F 37/26*** | (2006.01) |
| *D06F 37/12* | (2006.01) |

(56) References Cited

FOREIGN PATENT DOCUMENTS

| | | |
|---|---|---|
| CN | 204474981 U | 7/2015 |
| JP | 4-61896 A | 2/1992 |

OTHER PUBLICATIONS

Written Opinion (PCT/ISA/237) dated Mar. 2, 2016, by the Chinese Patent Office as the International Searching Authority for International Application No. PCT/CN2015/095297.

CONTROL METHOD FOR AUTOMATICALLY POSITIONING INNER TUB

TECHNICAL FIELD

The present disclosure relates to a field of washing machines, in particular to a control method for automatically positioning an inner tub.

BACKGROUND

In exiting pulsator type washing machines, drain holes are formed in an inner tub, the inner tub which is a washing tub communicates with an outer tub which is a water container. Water filling the space between the side walls of the inner tub and the outer tub does not participate in washing, and only water in the inner tub really participates in washing, so that water resources are greatly wasted. In addition, the concentration of detergents/washing powder in washing solutions is reduced by excessive water between the inner and outer tubs. Meanwhile, as the water frequently flows in and out of the inner and outer tubs, after continuous usage, the area between the side walls of the inner tub and the outer tub becomes a space containing dirt and dust. And incrustation in running water, free substances of the washing powder, cellulose of clothes, organic matters of human bodies and dust and germs brought by the clothes are extremely prone to be retained between the side walls of the inner tub and the outer tub. A large quantity of dirt accumulated in the washing machine after long time use causes breeding of mould, and if the dirt is not removed, at the next time of washing, the germs will be attached to the clothes and brought to the human bodies to cause cross infection.

Patent 201210011789.1 relates to a sealed inner tub comprising a side wall and a bottom integrally connected, wherein the side wall and the bottom are hermetically arranged, a water drain groove is arranged on the top of the side wall, and water in the inner tub and clothes completely drains to the outside of the inner tub through the water drain groove. The patent also relates to a washing machine with the sealed inner tub and a washing method of the washing machine. Due to the no-hole design of the inner tub, washing water does not need to enter the area between the inner tub and the outer tub, so that the purpose of greatly saving the washing water is achieved. Meanwhile, dirt and bred germs retained in the area between the inner tub and the outer tub do not contact the clothes in the inner tub through water flows, so that cross infection of the germs can be effectively avoided, and thus the washing machine is more sanitary and environment-friendly and safer to use. However, all water drains from the upper part, and lint and silt in the water cannot be completely discharged and remained in the inner tub, so that pollution is caused again at the next time of washing clothes.

Patent 200420107890.8 relates to a full-automatic washing machine mainly comprising a casing, a washing and dewatering tub, a water container tub and a drive device, wherein the water container tub is installed outside the washing and dewatering tub and fixedly connected with the casing. A sealing device is arranged between the bottom surface of the inner wall of the water container tub and the bottom surface of the outer wall of the washing and dewatering tub, and a sealed cavity is formed in the sealing device. No through hole is formed in the outer side wall of the washing and dewatering tub, and a drain hole communicating with the sealed cavity is formed in the bottom of the washing and dewatering tub; and a first drain hole communicating with a drain pipe is formed in the water container tub, and a drain valve is arranged on the drain pipe. The water container tub is fixedly connected with the casing via a suspension rod. One end of the suspension rod is connected with the inner wall of the upper end of the casing, while the other end is connected with the outer wall of the water container tub. But after long-time operation, the sealing structure is prone to leak water due to wearing, and if the water is poor in quality and high in sediment concentration, the service life of the sealing structure may be greatly reduced and the sealing structure cannot provide a proper function. The full-automatic washing machine is not used under the condition of large washing capacity either, and poor in reliability.

A preferred scheme is as follows: the drain hole in the bottom of the inner tub is not located in the center of the bottom of the inner tub, but formed in an off-centered side of the bottom of the inner tub; a control structure of the drain hole is arranged at the bottom of the outer tub. If the control structure is arranged on the off-centered side of the bottom of the inner tub, the inner tub rotates during dewatering, and thus the inner tub needs to be positioned every time after dewatering or before washing water feeding to ensure that the drain hole of the inner tub is aligned with the control structure of the drain hole of the outer tub, and also ensure that the inner tub does not rotate during washing.

Therefore, the present disclosure is provided.

SUMMARY

The purpose of the present disclosure is to overcome defects in the prior art, and provide a control method for automatically positioning an inner tub, so that the inner tub can be automatically positioned.

In order to achieve the purpose, the present disclosure adopts a technical scheme as follows: a control method for automatically positioning an inner tub is provided, wherein a positioning hole is formed in a bottom of the inner tub. A positioning pin is arranged at the bottom of an outer tub, and the positioning pin is provided with a structure capable of driving the positioning pin to extend and retract. When the inner tub rotates to a certain position, the positioning pin is released to press against the bottom of the inner tub, the inner tub continues to rotate, and when the inner tub rotates to a position where the positioning hole is aligned with the positioning pin, the positioning pin stretches into the positioning hole, and thus the inner tub is locked.

After the positioning pin is released, the inner tub continues to rotate under the drive of a motor, and when the inner tub rotates to the position where the positioning hole is aligned with the positioning pin, the positioning pin stretches into the positioning hole, and thus the inner tub is locked, and then the motor stops rotating.

The positioning pin stretches into the hole to trigger a detection switch arranged in the positioning hole so as to control the motor to stop rotating.

After the positioning pin is released, the motor stops rotating, the inner tub continues to rotate by its own inertia, and when the inner tub rotates to the position where the positioning hole is aligned with the positioning pin, the positioning pin stretches into the positioning hole, and thus the inner tub is locked.

Step 1, weighing is performed to determine the weight of a load, after the motor stops rotating, the inner tub continues to rotate under its own inertia at a speed v by an angle $\alpha$ which is determined according to the weight of the load;

step 2, the motor is controlled to drive the inner tub at the speed v, and when the inner tub rotates to a position where an included angle between the positioning hole and the positioning pin is less than or equal to a, the positioning pin is released, and the motor stops rotating; and step 3, the positioning pin presses against the bottom of the inner tub, the inner tub continues to rotate under the effect of inertia, and when the inner tub rotates to the position where the positioning hole is aligned with the positioning pin, the positioning pin automatically stretches into the positioning hole to achieve positioning of the inner tub.

Angles $\alpha$ corresponding to various speeds and loads are measured via tests and written into a program of a washing machine, and in the step 1, a corresponding angle $\alpha$ is retrieved according to the speed and the load acquired by weighing.

In the step 2, a moment that the motor stops rotating is determined by determining operation time of the motor as the inner tub rotates from a certain position A to the position where the included angle between the positioning hole and the positioning pin is less than or equal to $\alpha$.

The motor is controlled to drive the inner tub at the speed v, and operation time of the motor as the inner tub rotates for one round is t1 and satisfies $t1=360°/v$. From the time when the positioning hole passes by the positioning pin to the time when the included angle between the positioning hole and the positioning pin is equal to the angle $\alpha$, operation time of the motor is t2 and satisfies $t2=(360°-\alpha)/v$. And in the step 2, timing is started when the positioning hole passes by the positioning pin, operation time of the motor until the motor stops rotating is t and satisfies $t2 \leq t \leq t1$, preferably, $t=t2$.

Angles $\alpha$ corresponding to various speeds and loads, and operation time t3 of the motor as the inner tub rotates from the certain position A to the position where the included angle between the positioning hole and the positioning pin is equal to a are measured through tests, and correspondingly written into the program of the washing machine. In the step 2, a corresponding operation time t3 is retrieved according to the speed and the load, and thus a moment that the motor stops rotating is determined.

In the step 2, an angle $\alpha 1$ corresponding to the minimum load is retrieved, and when the inner tub rotates to a position where the included angle between the positioning hole and the positioning pin is less than or equal to the angle $\alpha 1$, the positioning pin is released, and the motor is controlled to stop rotating.

By adopting the above technical scheme of the present disclosure, the following beneficial effects are achieved:

1. The positioning hole is arranged in the bottom of the inner tub, the positioning pin is arranged at the bottom of the outer tub. And the positioning pin is provided with the structure capable of driving the positioning pin to extend and retract, so that the positioning pin automatically stretches into the positioning hole to achieve automatic positioning of the inner tub, the inner tub is prevented from shaking along with the rotation of an pulsator. And sealing of the drain hole and the drainage control structure can also be ensured so as to prevent water leakage.

2. After the motor stops operating, the inner tub can just rotate under the effect of inertia to a position where the positioning hole aligns with the positioning pin, the positioning pin stretches into the positioning hole, and the inner tub does not have a rotating trend. So that no impact force or a small impact force is applied to the positioning pin, and thus the service life of the positioning pin can be prolonged.

3. When the included angle between the positioning hole and the positioning pin is less than or equal to $\alpha$, the motor stops rotating, and the positioning pin is released. An allowance is set, and the condition that the inner tub cannot be positioned due to the fact that the inner tub stops rotating when the positioning hole does not yet rotate to the position of the positioning pin under the influence of external factors is avoided.

4. During washing, the washing water is only contained in the inner tub, and no washing water between the inner tub and the outer tub, so that the washing machine has the feature of water-saving. During a draining and/or dewatering process, the first drain hole is opened, and most of water and sediments such as silt and particles are drained into the outer tub through the first drain hole at the lower part. And water contained in clothes is drained into the outer tub through second drain holes in the upper part of the inner tub when the inner tub rotates at a high speed for dewatering, and then directly drained to the outside of the washing machine through a drain outlet and a drain pipe at the bottom of the outer tub. So that rapid drainage and good drain and pollution discharge effects are achieved.

Embodiments of the present disclosure are described in detail bellow with reference to accompanying drawings.

DETAILED DESCRIPTION

Figure 1:
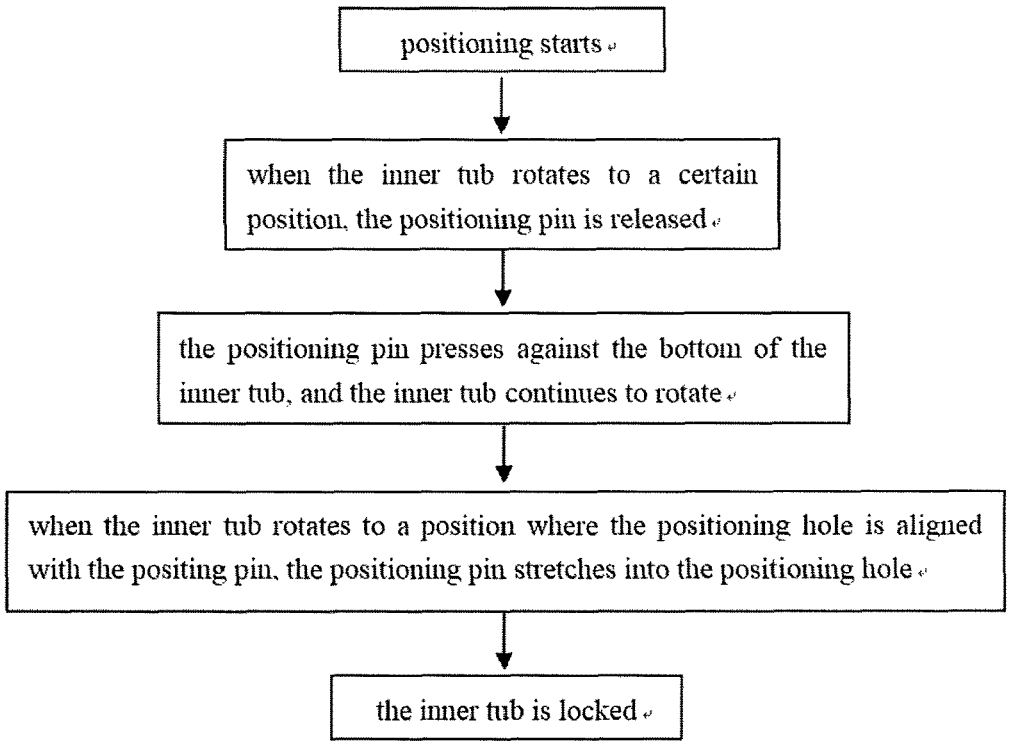
FIG. 1 is a flow chart of a control method provided by the present disclosure.

A washing machine of the present disclosure is a full-automatic washing machine, and during washing, an inner tub does not rotate while an pulsator rotates; in order to prevent the inner tub from shaking along with the rotation of the pulsator, a positioning hole is formed in the bottom of the inner tub, a positioning pin is arranged at the bottom of an outer tub, the positioning pin is provided with a structure capable of driving the positioning pin to extend and retract, and the positioning pin automatically stretches into the positioning hole such that the inner tub is positioned.

Alternatively, there is no water between inner and outer tubs during washing of a washing machine of the present disclosure. The washing machine comprises an inner tub and an outer tub, wherein the inner tub does not have water holes communicating with the outer tub. At least one first drain hole is formed in the bottom of the inner tub, and a circle of second drain holes are formed in the upper part of the inner tub. During washing, the first drain hole in the bottom of the inner tub is closed, water only exists in the inner tub, and no water exists between the inner and outer tubs. After washing ends, the first drain hole in the bottom of the inner tub is opened, most of the water is discharged through the first drain hole. During dewatering, the inner tub rotates, and water separated from the clothes rises along the tub wall under the effect of a centrifugal force and is drained out of the inner tub to an area between the inner and outer tubs via the second drain holes in the upper part of the inner tub, and then drains to the outside via the drain hole of the outer tub. So that during washing, the washing water is only contained in the inner tub, no washing water exists between the inner and outer tubs, and thus the washing machine has the feature of water-saving. During a draining and/or dewatering process, the first drain hole is opened, most of water and sediments such as silt and particles are drained into the outer tub through the first drain hole in the lower part, and water contained in clothes is drained into the outer tub through the second drain holes in the upper part of the inner tub when the inner tub rotates at a high speed for dewatering and directly the water is drained to the outside of the washing machine through a drain outlet and a drain pipe at the bottom of the outer tub. And thus rapid drainage and good drain and pollution discharge effects are achieved.

A drainage control structure for controlling the first drain hole to be opened/closed is arranged below the first drain hole, and the drain control structure is arranged at the bottom of the outer tub. During washing, the drainage control structure controls the first drain hole to be closed; during dewatering, the drainage control structure controls the first drain hole to be opened. As the first drain hole is formed in the inner tub, during washing, the inner tub is fixed and only the pulsator rotates, and during dewatering, the inner tub and the pulsator rotate together. The first drain hole of the inner tub moves during dewatering, but the drainage control structure of the first drain hole is static, so that when the washing machine switches to a washing state, the drain hole and the drainage control structure are not always at the same location, and the first drain hole needs to be aligned with the drainage control structure. According to the present disclosure, the positioning hole is formed in the bottom of the inner tub, the positioning pin is arranged at the bottom of the outer tub, the positioning pin is provided with the structure capable of driving the positioning pin to extend and retract, and the positioning pin automatically stretches into the positioning hole such that the inner tub is positioned. Besides, the inner tub is controlled to be positioned at the same location every time, so that it is ensured that the first drain hole in the inner tub is aligned with the drainage control structure, and the inner tub is locked so as to be prevented from rotating during washing. If the positions of the first drain hole and the drainage control structure are misaligned, the drainage control structure is invalid, and the inner tub leaks water.

As shown in the FIG. 1, a control method for automatically positioning an inner tub is provided by the present disclosure, wherein a positioning hole is formed in the bottom of the inner tub, a positioning pin is arranged at the bottom of an outer tub, and the positioning pin is provided with a structure capable of driving the positioning pin to extend and retract; when the inner tub rotates to a certain position, the positioning pin is released to press against the bottom of the inner tub, the inner tub continues to rotate, and when the inner tub rotates to a position where the positioning hole is aligned with the positioning pin, the positioning pin stretches into the positioning hole, and thus the inner tub is locked.

Figure 2:
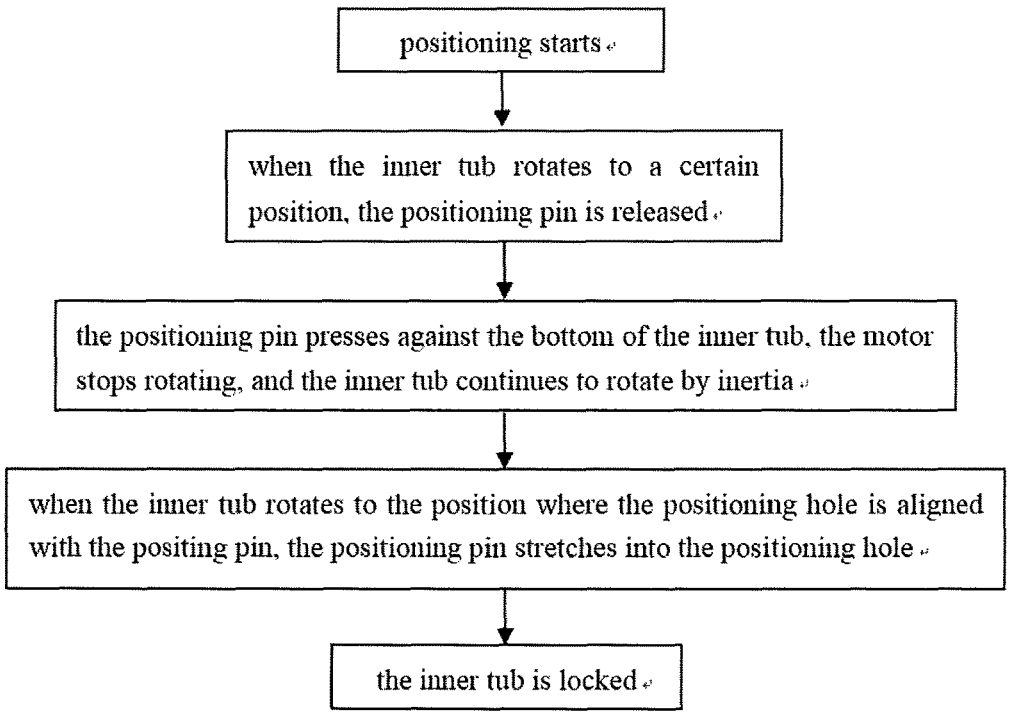
FIG. 2 is a flow chart of a control method provided by the present disclosure.

As shown in the FIG. 2, after the positioning pin is released, a motor stops rotating, the inner tub continues to rotate by its own inertia, and when the inner tub rotates to the position where the positioning hole is aligned with the positioning pin, the positioning pin stretches into the positioning hole, and thus the inner tub is locked.

Figure 4:
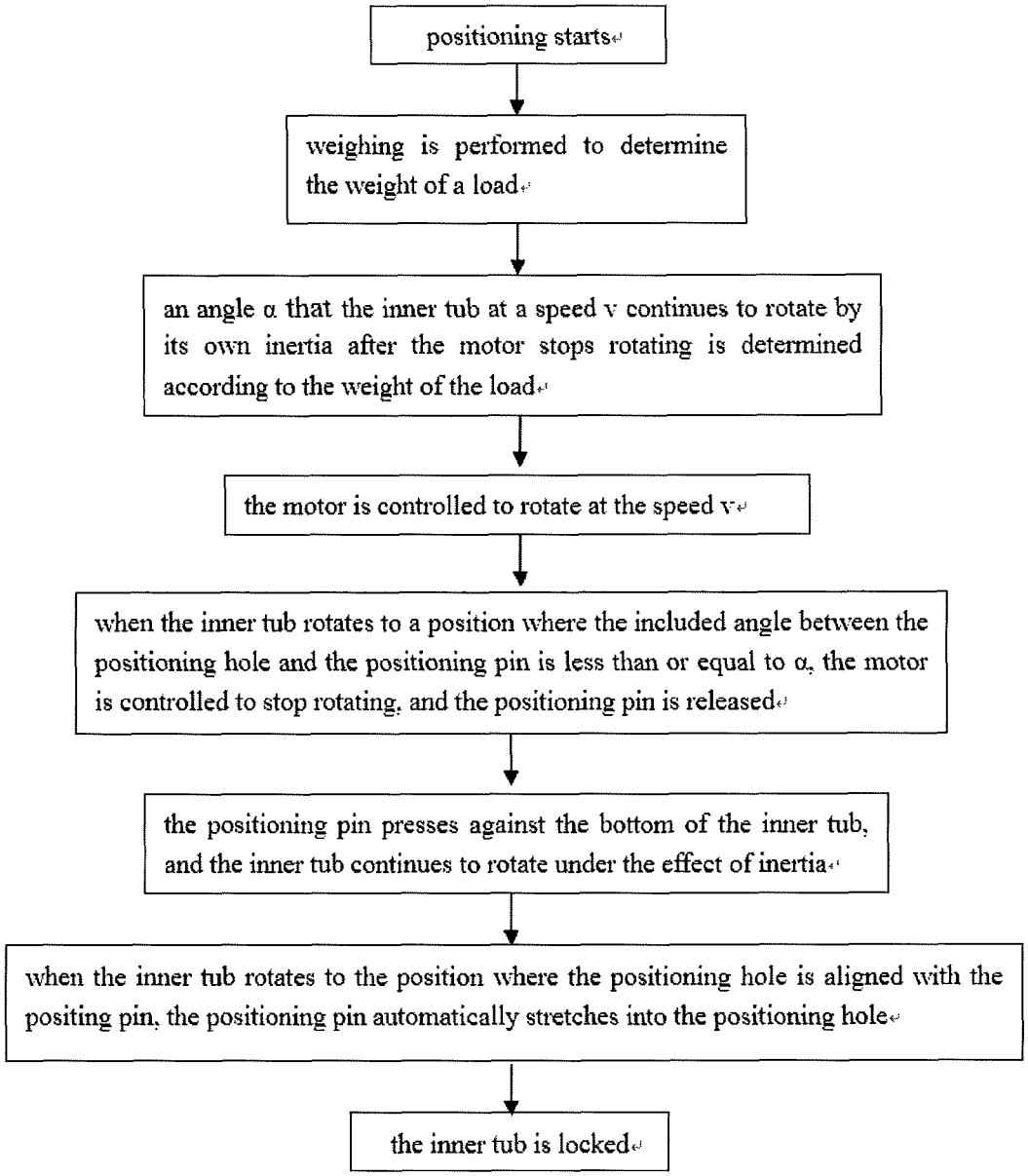
FIG. 4 is a flow chart of a control method provided by the present disclosure.

As shown in the FIG. 4, the inner tub is positioned through the following steps:

step 1, weighing is performed to determine the weight of a load, after the motor stops rotating, the inner tub continues to rotate under its own inertia at a speed v by an angle $\alpha$ which is determined according to the weight of the load.

The angles $\alpha$ corresponding to various speeds and loads are measured through tests and written into a program of a washing machine, and a corresponding angle $\alpha$ is retrieved according to the speed and the load acquired by weighing. In such manner, the washing machine can directly retrieve the corresponding value, a computing process of a controller is eliminated, and thus control becomes simpler and more convenient and less time is used.

The maximum load of the washing machine is m1 kg, by taking a relatively small weight m2 kg as a unit, angles $\alpha$ corresponding to loads between m2 kg and m1 kg, i.e. m2, 2m2, 3m2, 4m2 . . . m1, of the washing machine at different speeds are tested and written into the program of the washing machine. In the step 1, a corresponding angle $\alpha$ is retrieved according to the speed and the weight of the load acquired by weighing, and a ratio range of m2 to m1 is from (1:30) to (1:5), preferably from (1:20) to (1:10). The smaller the ratio of m2 to m1 is, the smaller a measurement section is, and more accurate a corresponding value becomes. The load of the washing machine comprises a dry weight and a wet weight which satisfy: wet weight=dry weight*water absorption.

If the full load weight is 10 kg, by taking 1 kg as a unit, the washing machine rotates at the speed v with loads of 1, 2, 3, 4, 5, 6, 7, 8, 9 and 10 kg, after the motor stops rotating, the inertial angles corresponding to different loads are tested, and data are written into a form which is built to put into the program. The load weight of the whole machine can be acquired by weighing, and the corresponding angle $\alpha$ can be retrieved. In order to achieve more general application and expansion, a balance ring radius parameter can be added, and the controller can directly retrieve the angle according to different types and different weights. Wet weights corresponding to 1-10 kg are also tested, and if the moisture content is 100%, the inertial angles corresponding to 2, 4, 6 . . . 20 kg need to be tested.

Step 2, the motor is controlled to drive the inner tub to rotate at the speed v, and when the included angle between the positioning hole and the positioning pin is less than or equal to $\alpha$, the motor is controlled to stop rotating, and the positioning pin is released. An allowance is set, so that the condition that the inner tub cannot be positioned due to the fact that the inner tub stops rotating when the positioning hole does not yet rotate to the position of the positioning pin under the influence of external factors is avoided.

A moment that the motor stops rotating is determined by determining operation time of the motor as the inner tub rotates from a certain position A to the position where the included angle between the positioning hole and the positioning pin is less than or equal to the angle $\alpha$ that the inner tub rotates from the speed v until stopping under the effect of inertia. Operation time of the motor as the inner tub rotates from the certain position A to the position where the included angle between the positioning hole and the positioning pin is less than or equal to a is determined, timing is started when the inner tub rotates to the position A, after the time is up, the inner tub stops rotating, and the positioning pin is released.

The operation time of the motor as the inner tub rotates from the certain position A to the position where the included angle between the positioning hole and the positioning pin is less than or equal to the angle $\alpha$ that the inner tub rotates from the speed v until stopping under the effect of inertia can be acquired through computation: the motor is controlled to drive the inner tub to rotate at the speed v, and operation time of the motor as the inner tub rotates for one round is t1 and satisfies t1=360°/v. From the time the positioning hole passes by the positioning pin of the outer tub to the time when the included angle between the positioning hole and the positioning pin is equal to α, operation time of the motor is t2 and satisfies t2=(360°−α)/v. And timing is started when the positioning hole of the inner tub passes by the positioning pin of the outer tub, operation time of the motor until the motor stops rotating is t and satisfies t2≤t≤t1, so that after the motor stops rotating, the inner tub can rotate to the position where the positioning hole is aligned with the positioning pin only under the effect of inertia, and the positioning hole and the positioning pin are matched for positioning the inner tub.

If the positioning pin suddenly brakes the inner tub when the inner tub rotates at a high speed, an impact force to the positioning pin is large, and the instant impact force may cut off the positioning pin and cause a fault of the washing machine. Therefore, preferably, t=t2; in such case, after the motor stops operating, the inner tub stops when just rotating to the position where the positioning hole is aligned with the positioning pin only under the effect of inertia. At this moment the positioning pin stretches into the positioning hole, and the inner tub does not have a rotating trend, so that no impact force is applied to the positioning pin, and thus the service life of the positioning pin can be prolonged.

Preferably, t is slightly larger than t2. The inner tub may stop rotating at a position where the positioning hole is not yet aligned with the positioning pin under the influence of slight external factors, and thus the inner tub cannot be positioned. When t is slightly larger than t2, α may be reduced under the effect of external resistance, but, as the allowance is set, and thus it still can be ensured that the inner tub can rotate to the position where the positioning hole is aligned with the positioning pin.

Alternatively, the operation time of the motor as the inner tub rotates from the certain position A to the position where the included angle between the positioning hole and the positioning pin is less than or equal to a is written into the program of the washing machine in advance, and is directly retrieved in operation. Angles α corresponding various speeds and loads, and operation time t3 of the motor as the inner tub rotates from the certain position A to the position where the included angle between the positioning hole and the positioning pin is equal to α are measured through tests and correspondingly written into the program of the washing machine; and a corresponding operation time t3 is retrieved according to the load acquired by weighing, and thus a moment that the motor stops rotating is determined.

When the maximum load of the washing machine is m1 kg, by taking a relative small weight m2 kg as a unit, angles α corresponding to loads between m2 kg-m1 kg of the washing machine at different speeds are tested, and the operation time t3 of the motor as the inner tub rotates from the certain position A to the position where the included angle between the positioning hole and the positioning pin is equal to α are measured. The data of angles and operation time are written into the program of the washing machine, and the corresponding angle α and t3 are retrieved according to the load acquired by weighing. Timing is started when the inner tub rotates from the position A, and the motor stops operating after the operation time t, and t satisfies t3≤t≤(t3+α/v), so that it is ensured that after the motor stops rotating, the inner tub can rotate to the position where the positioning hole is aligned with the positioning pin only under the effect of inertia, and the positioning hole and the positioning pin are matched for positioning the inner tub.

If the positioning pin suddenly brakes the inner tub when the inner tub rotates at a high speed, an impact force to the positioning pin is large, and the instant impact force may cut off the positioning pin and cause a fault of the washing machine. Therefore, preferably, t=t3; in such case, after the motor stops operating, the inner tub stops when just rotating to the position where the positioning hole is aligned with the positioning pin, and at this moment the positioning pin stretches into the positioning hole and the inner tub does not have a rotating trend, so that no impact force is applied to the positioning pin, and thus the service life of the positioning pin can be prolonged.

Preferably, t is slightly larger than t3. The inner tub may stop rotating at a position where the positioning hole is not yet aligned with the positioning pin under the influence of slight external factors, and thus the inner tub cannot be positioned. When t is slightly larger than t3, the angle α that the inner tub rotates from the speed v until stopping under the effect of inertia may be reduced under the effect of external resistance, but, the allowance is set, so that it still can be ensured that the inner tub can rotate to the position wherein the positioning hole is aligned with the positioning pin.

Step 3, the positioning pin presses against the bottom of the inner tub, the structure capable of driving the positioning pin to extend and retract is not completely released, the inner tub continues to rotate under the effect of inertia. And when the inner tub rotates to the position where the positioning hole is aligned with the positioning pin, the positioning pin automatically stretches into the positioning hole, and thus the inner tub is positioned.

The range of the speed v is 5 r/min-50 r/min, preferably 10 r/min-20 r/min. When the speed is too small, the angle α that the inner tub rotates only under the effect of inertia is also too small, the inner tub may stop rotating at a position where the positioning hole is not yet aligned with the positioning pin under the influence of slight external factors, and thus the inner tub cannot be positioned. When the speed is too large, the angle α the inner tub rotates only under the effect of inertia is also too large, time taken by the inner tub to rotate to the position where the positioning hole is aligned with the positioning pin is too long, and thus time of the whole positioning process is relatively long, and washing time is prolonged.

A signal sensing/transmitting device is arranged on the outer tub at a position corresponding to the positioning pin, a signal transmitting/sensing device is arranged on the inner tub at a position corresponding to the positioning hole, and when the signal sensing device detects a signal transmitted by the signal transmitting device, the inner tub rotates to the position where the positioning hole is aligned with the positioning pin. A Hall sensor or a photoelectric sensor or a reed switch can be used for detection, or any sensor which can detect a signal when the position is aligned can be used for detection. For example, the Hall sensor is arranged on the outer tub at a position corresponding to the positioning pin, a magnet is arranged on the inner tub at a position corresponding to the positioning hole, and when the Hall sensor detects the signal of the magnet, the inner tub rotates to the position where the positioning hole is aligned with the positioning pin. Alternatively, the photoelectric sensor is arranged on the outer tub at a position corresponding to the positioning pin, a luminophor is arranged on the inner tub at a position corresponding to the positioning hole, and when the photoelectric sensor detects an optical signal of the luminophor, the inner tub rotates to the position where the positioning hole is aligned with the positioning pin. When the signal is detected continuously (1s or 2s), it is judged that the positioning pin has already entered the hole.

The motor is a motor for driving the inner tub to rotate.

In the step 2, an angle α1 corresponding to the minimum load can also be retrieved, and when the inner tub rotates to a position where the included angle between the positioning hole and the positioning pin is less than or equal to the angle α1, the motor is controlled to stop rotating, and the positioning pin is released.

Angles α1 corresponding to the minimum load of the washing machine at different speeds can be measured through tests, a signal transmitting device/signal sensing device is arranged on the inner tub at a position which is away from the positioning hole with a angle of α1 in a direction opposite to the rotation direction of the inner tub, a signal sensing device/signal transmitting device is arranged on the outer tub at a position corresponding to the positioning pin, and when a signal is received, the positioning pin is released. With the minimum load, the inner tub just rotates to the position where the positioning hole is aligned with the positioning pin under the effect of inertia, and the positioning pin is released; the larger the load is, the larger the inertia is, so that it is ensured that the inner tub within the maximum load range rotates to the position where the positioning hole is aligned with the positioning pin under the effect of inertia, the positioning pin automatically stretches into the positioning hole, and thus positioning of the inner tub is achieved.

Alternatively, two magnets are used, the first magnet is used for positioning, and the second magnet is used for providing a signal for releasing the positioning pin and controlling the motor to stop. The position of the second magnet can be determined according to the measurement method of the angle α1, and after the positions of the magnets are determined, time t12 it takes to rotate from the first magnet to the second magnet and time t21 it takes to rotate from the second magnet to the first magnet can be acquired. After the motor drives the inner tub to rotate at the speed v, and timing is started when a Hall signal is detected for the first time, operation time t4 of this process from the start of timing until the Hall signal is detected for the second time is acquired, and timing is continued and meanwhile a controller performs computation: when t4=t21, the magnet passed by for the second time is an initial position, the motor stops action when the Hall signal is received again, and the releasing of the positioning pin is stopped; and when t4=t12, the magnet passed by for the first time is an initial position, the motor is directly controlled to stop rotating and the positioning pin is released.

Figure 3:
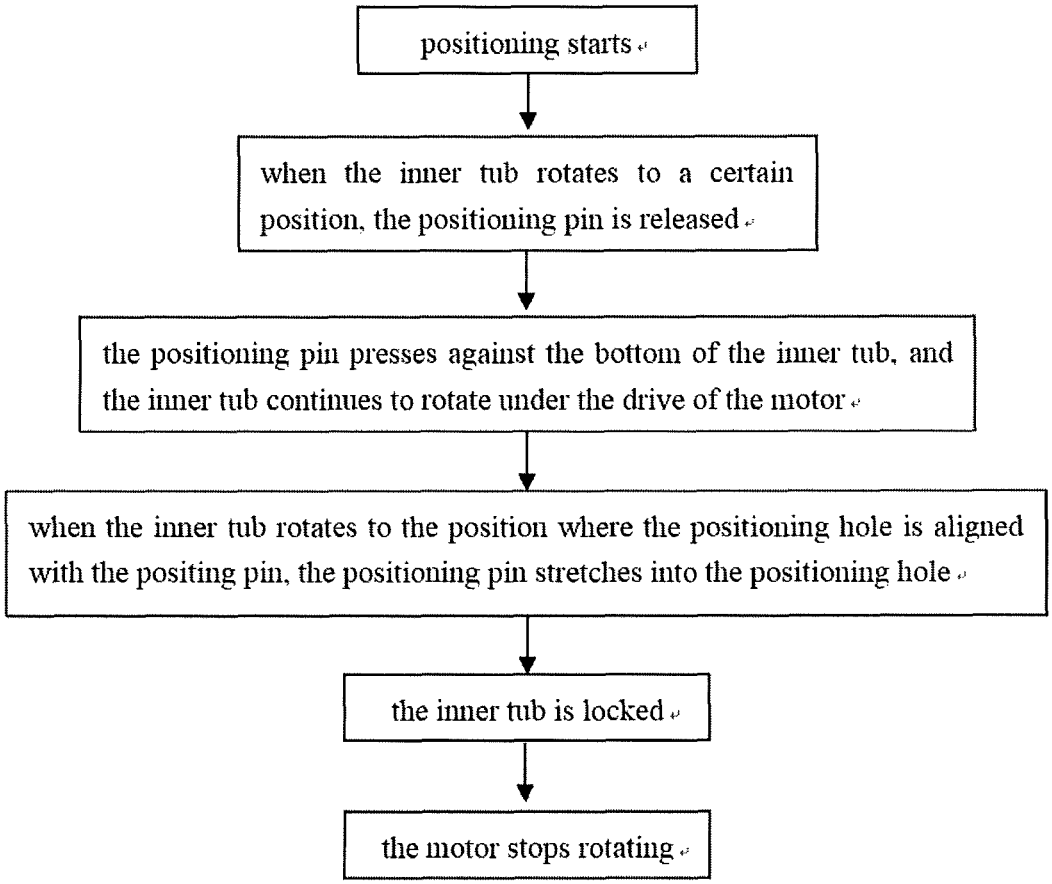
FIG. 3 is a flow chart of a control method provided by the present disclosure.

As shown in the FIG. 3, a control method for automatically positioning an inner tub is provided by another embodiment of the present disclosure, wherein a positioning hole is formed in the bottom of the inner tub, a positioning pin is arranged at the bottom of an outer tub, and the positioning pin is provided with a structure capable of driving the positioning pin to extend and retract. When the inner tub rotates to a certain position, the positioning pin is released to press against the bottom of the inner tub, the inner tub continues to rotate under the drive of a motor, and when the inner tub rotates to a position where the positioning hole is aligned with the positioning pin, the positioning pin stretches into the positioning hole, and thus the inner tub is locked. After the positioning pin is released, the inner tub continues to rotate under the drive of the motor, and when the inner tub rotates to the position where the positioning hole is aligned with the positioning pin, the positioning pin stretches into the positioning hole, and thus the inner tub is locked, and the motor stops rotating.

The range of the speed v is 1 r/min-5 r/min, preferably 3 r/min.

For example, the inner tub rotates uniformly at a speed of 3 r/min from a position A, timing is started when a signal is detected for the first time, the positioning pin is released after a time that the inner tub rotates ⅔ circle, the inner tub continues to rotate under the drive of the motor. And when the inner tub rotates to the position where the positioning hole is aligned with the positioning pin, the positioning pin automatically enters the hole; when a continuous (1s or 2s) Hall signal is detected, a controller of a washing machine judges that the positioning pin enters the hole, and then the motor stops rotating.

A signal sensing/transmitting device is arranged on the outer tub at a position corresponding to the positioning pin, a signal transmitting/sensing device is arranged on the inner tub at a position corresponding to the positioning hole, and when the signal sensing device detects a signal transmitted by the signal transmitting device, the inner tub rotates to the position where the positioning hole is aligned with the positioning pin. A Hall sensor or a photoelectric sensor or a reed switch can be used for detection, or any sensor which can detect a signal when the positions are aligned can be used for detection. For example, the Hall sensor is arranged on the outer tub at a position corresponding to the positioning pin, a magnet is arranged on the inner tub at a position corresponding to the positioning hole, when the Hall sensor detects a signal of the magnet, the inner tub rotates to the position where the positioning hole is aligned with the positioning pin. Alternatively, the photoelectric sensor is arranged on the outer tub at a position corresponding to the positioning pin, a luminophor is arranged on the inner tub at a position corresponding to the positioning hole, and when the photoelectric sensor detects an optical signal of the luminophor, the inner tub rotates to the position where the positioning hole is aligned with the positioning pin, and when the signal is continuously detected (1s or 2s), it is judged that the positioning pin has already entered the hole.

The abovementioned merely are embodiments of the present disclosure, it should be understood that some modifications or improvements without departing from the principles of the present disclosure are apparent to those ordinarily skilled in the art, and should be considered as falling within the scope of the present disclosure.

The invention claimed is:

1. A control method for automatically positioning an inner tub, comprising:

weighing a load loaded in the inner tub to determine a weight of the load, and determining an angle α at which the inner tub continues rotating under its own inertia at a speed v according to the weight of the load;

rotating the inner tub by a motor and stopping operation of the motor;

when the inner tub rotates to a position where an included angle between a positioning hole formed in a bottom of the inner tub and a positioning pin arranged at a bottom of an outer tub is less than or equal to α, the positioning pin being released to press against the bottom of the inner tub, and the inner tub continues rotating, and when the inner tub rotates to a position where the positioning hole is aligned with the positioning pin, the positioning pin stretches into the positioning hole, and the inner tub is locked.

2. The control method for automatically positioning the inner tub according to claim 1, wherein, after the positioning pin is released, the inner tub continues rotating under drive of a motor, and when the inner tub rotates to the position where the positioning hole is aligned with the positioning pin, the positioning pin stretches into the positioning hole, and the inner tub is locked, and then the motor stops rotating.

3. The control method for automatically positioning the inner tub according to claim 2, wherein the positioning pin stretches into the positioning hole to trigger a detection switch arranged in the positioning hole so as to control the motor to stop rotating.

4. The control method for automatically positioning the inner tub according to claim 1, wherein, after the positioning pin is released, a motor stops rotating, and the inner tub continues rotating by its own inertia, and when the inner tub rotates to the position where the positioning hole is aligned with the positioning pin, the positioning pin stretches into the positioning hole, and the inner tub is locked.

5. A control method for automatically positioning an inner tub, the inner tub having been rotated by a motor, and the motor subsequently stopping operation, the method comprising the following steps:

step 1, weighing a load loaded in the inner tub to determine a weight of the load, and determining an angle $\alpha$ according to the weight of the load, wherein after the motor stops operating, the inner tub continues rotating under its own inertia at a speed v by the angle $\alpha$;

step 2, controlling the motor to drive the inner tub at the speed v, and when the inner tub rotates to a position where an included angle between the positioning hole and the positioning pin is less than or equal to $\alpha$, the positioning pin is released, and the motor stops operating; and step 3, the positioning pin presses against the bottom of the inner tub, the inner tub continues rotating under the effect of inertia, and when the inner tub rotates to the position where the positioning hole is aligned with the positioning pin, the positioning pin automatically stretches into the positioning hole, and the inner tub is positioned.

6. The control method for automatically positioning the inner tub according to claim 5, wherein angles $\alpha$ corresponding to various speeds and loads are measured through tests and written into a program of the washing machine, and in the step 1, angle $\alpha$ is retrieved according to the speed and the load acquired by weighing.

7. The control method for automatically positioning the inner tub according to claim 5, wherein, in the step 2, a moment that the motor stops operating is determined by determining an operation time of the motor as the inner tub rotates from the position A to the position where the included angle between the positioning hole and the positioning pin is less than or equal to $\alpha$.

8. The control method for automatically positioning the inner tub according to claim 7, wherein, the motor is controlled to drive the inner tub at the speed v, and an operation time of the motor as the inner tub rotates for one round is t1 and satisfies $t1=360°/v$;

from a time when the positioning hole passes by the positioning pin to a time when the included angle between the positioning hole and the positioning pin is equal to the angle $\alpha$, an operation time of the motor is t2 and satisfies $t2=(360°-\alpha)/v$;

and in the step 2, timing is started when the positioning hole passes by the positioning pin, and an operation time of the motor until the motor stops operating is t and satisfies $t2 \leq t \leq t1$.

9. The control method for automatically positioning the inner tub according to claim 5, wherein angles $\alpha$ corresponding to various speeds and loads, and an operation time t3 of the motor as the inner tub rotates from the position A to the position where the included angle between the positioning hole and the positioning pin is equal to $\alpha$ are measured through tests, and correspondingly written into the program of the washing machine;

and in the step 2, the operation time t3 is retrieved according to the speed and the load, and the moment that the motor stops operating is determined.

10. The control method for automatically positioning the inner tub according to claim 5, wherein, in the step 2, an angle $\alpha 1$ corresponding to a minimum load is retrieved, and when the inner tub rotates to the position where the included angle between the positioning hole and the positioning pin is less than or equal to the angle $\alpha 1$, the positioning pin is released, and the motor is controlled to stop operating.

11. The control method for automatically positioning the inner tub according to claim 8, wherein $t=t2$.

12. The control method for automatically positioning the inner tub according to claim 5, wherein the motor is controlled to drive the inner tub at the speed v, and an operation time of the motor as the inner tub rotates for one round is t1 and satisfies $t1=360°/v$;

from a time when the positioning hole passes by the positioning pin to a time when the included angle between the positioning hole and the positioning pin is equal to the angle $\alpha$, an operation time of the motor is t2 and satisfies $t2=(360°-\alpha)/v$;

and in the step 2, timing is started when the positioning hole passes by the positioning pin, and an operation time of the motor until the motor stops operating is t and satisfies $t2 \leq t \leq t1$.

13. The control method for automatically positioning the inner tub according to claim 7, wherein angles $\alpha$ corresponding to various speeds and loads, and an operation time t3 of the motor as the inner tub rotates from the position A to the position where the included angle between the positioning hole and the positioning pin is equal to $\alpha$ are measured through tests, and correspondingly written into the program of the washing machine;

and in the step 2, the operation time t3 is retrieved according to the speed and the load, and the moment that the motor stops rotating operating is determined.

14. The control method for automatically positioning the inner tub according to claim 6, wherein, in the step 2, an angle $\alpha 1$ corresponding to a minimum load is retrieved, and when the inner tub rotates to the position where the included angle between the positioning hole and the positioning pin is less than or equal to the angle $\alpha 1$, the positioning pin is released, and the motor is controlled to stop operating.

* * * * *